United States Patent [19]

Sims et al.

[11] Patent Number: 4,923,631

[45] Date of Patent: May 8, 1990

[54] PERFUME AND BLEACH COMPOSITIONS

[75] Inventors: Peter S. Sims, Chester; Peter Carter, Burton, both of Great Britain

[73] Assignee: Lever Brothers Company, New York, N.Y.

[21] Appl. No.: 211,659

[22] Filed: Jun. 27, 1988

[30] Foreign Application Priority Data

Jul. 9, 1987 [GB] United Kingdom ..... 8716219

[51] Int. Cl.[5] ..... D06L 3/02; C11D 3/39; C11D 3/395; C11D 3/50

[52] U.S. Cl. ..... 252/186.42; 252/186.43; 252/95; 252/102; 252/174.11

[58] Field of Search ..... 252/186.42, 186.43, 252/174.11, 94, 95, 102

[56] References Cited

U.S. PATENT DOCUMENTS 4,006,092 2/1977 Jones ..... 252/186.42
4,170,453 10/1979 Kitko ..... 252/186.42 X
4,663,068 5/1987 Hagemann et al. ..... 252/99
4,741,853 5/1988 Walker et al. ..... 252/186.43 X
4,741,856 5/1988 Taylor et al. ..... 252/174.11 X
4,804,491 2/1989 Choy et al. ..... 252/186.43 X

FOREIGN PATENT DOCUMENTS 63-275697 11/1988 Japan ..... 252/174.11
1293253 10/1972 United Kingdom .

*Primary Examiner*—Brooks H. Hunt
*Assistant Examiner*—Virginia B Caress
*Attorney, Agent, or Firm*—Milton L. Honig

[57] ABSTRACT

Peracid bleach-stable perfume compositions comprise components which do not contain alkenyl or alkynyl groups and have a PSV of at least about 65% selected from: saturated alcohols, esters, aromatic ketones, lactones, nitriles, ethers, acetals, phenols, hydrocarbons and aromatic nitromusks and mixtures thereof.

The perfume compositions are used in bleach and/or detergent compositions containing a peracid bleach.

6 Claims, No Drawings

PERFUME AND BLEACH COMPOSITIONS

FIELD OF THE INVENTION

The invention relates to perfume compositions which are stable to a commercially usable level in the presence of bleaching compositions comprising peracid bleaching materials. The invention also relates to bleaching compositions containing such perfumes. These bleaching compositions are particularly, but not exclusively, suited to the bleaching of fabrics, and for this purpose they may also contain detergent active compounds.

BACKGROUND OF THE INVENTION

There has long existed a problem in the formulation of bleaching compositions in that the effective perfuming of such compositions is difficult to achieve. The perfume is required to remain stable at a commercially usable level during storage prior to use and then be available for effective delivery to the surface without being altered or destroyed by the bleach component.

Perfume is added to a bleach composition, in particular a detergent composition, to provide an olfactory benefit in the product during use and to enhance the olfactory properties of the treated surface.

The effective perfuming of fabric, as an example of surfaces, that has already been bleached and washed can be achieved by incorporation of a suitable perfume in a fabric conditioner to be added during the rinsing or drying stage subsequent to a bleaching and washing step, but this necessitates the introduction of an additional step in the laundry process.

The use of peracids in detergent formulations presents a particularly hostile environment for perfume compositions. The present invention provides peracid bleach-stable perfume compositions. It is also known to generate a peracid bleaching species in the wash liquor by incorporating a peroxide bleach material, for example sodium perborate, and a bleach precursor, for example N,N,N$^1$,N$^1$-tetraacetyl ethylene diamine (TAED). The present invention does not relate to these systems in which the peracid bleach species is formed in situ.

Neither should the term peracid, as used in this specification, be held to include hydrogen peroxide or bleaches which work by generating hydrogen peroxide, such as, for example, sodium perborate, and sodium percarbonate.

GENERAL DESCRIPTION OF THE INVENTION

In its widest aspect, the invention provides a bleach composition containing a peracid bleach and a perfume composition comprising components which do not contain alkenyl or alkynyl groups and have a PSV (as defined hereafter) of at least about 65% selected from the groups consisting of:

(i) saturated alcohols
(ii) saturated esters
(iii) saturated aromatic ketones
(iv) saturated lactones
(v) saturated nitriles
(vi) saturated ethers
(vii) saturated acetals
(viii) saturated phenols
(ix) saturated hydrocarbons, and
(x) aromatic nitromusks
and mixtures thereof.

The terms "saturated" is used herein to define groups not containing alkenyl or alkynyl bonds.

In a more specific aspect, the invention provides a bleach composition comprising an effective amount of a peracid bleach and up to about 10% by weight of a peracid-stable perfume composition as defined above.

Advantageously, the peracid-stable perfume composition will be present in an amount such that the level of the components defined above in the peracid bleach composition is at least 0.01% by weight, preferably within the range of from 0.01% to 2.5% by weight, more preferably from 0.03% to 1.5% by weight, and particularly preferably from 0.05% to 1.0% by weight.

Preferably, the peracid-stable perfume compositions for use in the present invention will contain at least about 80%, preferably about 90% by weight of the components defined above. Preferably, the components listed will have PSV's of at least 80%.

The bleach composition may also contain detergent active materials and will be referred to as bleach and/or detergent composition in the further description of this invention. The term peracid bleach, as used herein, includes both the organic and inorganic peroxyacids and their salts, which are well described in literature as having the ability of effective bleaching at lower wash temperatures of about 20°-60° C.

The organic peroxy acids usable in the present invention are compounds having the general formula:

$$HO-O-\overset{\overset{\displaystyle O}{\|}}{C}-(O)_n-R-Y$$

wherein R is an alkylene or substituted alkylene group containing 1 to 20 carbon atoms or an arylene group containing from 6 to 8 carbon atoms, n is 0 or 1, and Y is hydrogen, halogen, alkyl, aryl or any group which provides an anionic moiety in aqueous solution. Such Y groups can include, for example:

$$-\overset{\overset{\displaystyle O}{\|}}{C}-OM;\ -\overset{\overset{\displaystyle O}{\|}}{C}-O-OM;\ \text{or}\ -\underset{\underset{\displaystyle O}{\|}}{\overset{\overset{\displaystyle O}{\|}}{S}}-OM$$

wherein M is H or a water-soluble, salt-forming cation. Where n=0, they are sometimes also referred to as peroxycarboxylic acids and where n=1, they belong to the class of per(oxy)carbonic acids.

Preferred organic peroxyacids are solid at room temperature up to about 40° C. They can contain either one, two or more peroxy groups and can be either aliphatic or aromatic. When the organic peroxyacid is aliphatic, the unsubstituted acid may have the general formula:

$$HO-O-\overset{\overset{\displaystyle C}{\|}}{C}-(CH_2)_n-Y$$

wherein Y can be $$H,\ -CH_3,\ -CH_2Cl,\ -\overset{\overset{\displaystyle O}{\|}}{C}-OM,\ -\underset{\underset{\displaystyle O}{\|}}{\overset{\overset{\displaystyle O}{\|}}{S}}-OM\ \text{or}\ -\overset{\overset{\displaystyle O}{\|}}{C}-O-OM$$

and n can be an integer from 1 to 20, preferably from 4-16.

Examples of peroxyacids are peroxydodecanoic acids, peroxytetradecanoic acids and peroxyhexadecanoic acids, particularly 1,12-diperoxydodecanedioic acid being preferred. Other examples of suitable aliphatic peroxyacids are diperoxyazelaic acid, diperoxyadipic acid, diperoxysebacic acid and alkyl($C_1$–$C_{20}$) dipersuccinic acids.

When the organic peroxyacid is aromatic, the unsubstituted acid may have the general formula:

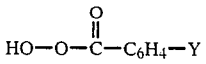

wherein Y is, for example, hydrogen, halogen, alkyl,

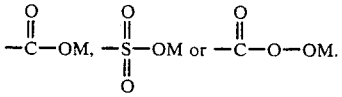

The percarboxy and Y groupings can be in any relative position around the aromatic ring. The ring and/or Y group (if alkyl) can contain any non-interfering substituents such as halogen or sulphonate groups. Examples of suitable aromatic peroxyacids and salts thereof include monoperoxyphthalic acid; diperoxyterephthalic acid; 4-chlorodiperoxyphthalic acid; diperoxyisophthalic acid; peroxy benzoic acids and ring-substituted peroxy benzoic acids, such as m-chloroperbenzoic acid and peroxy-alpha-naphthoic acid; and also magnesium monoperphthalate (obtainable under the tradename "H48" from Interox Chemicals Ltd.

Further examples of organic peroxyacid bleach compounds are described in the following patent literature: EP-A-0083560; EP-A-0105689; EP-A-0083560; EP-A-0166571; EP-A-0168204; EP-A-0195570; EP-A-0206624; and EP-A-0170386.

As inorganic peroxyacid salts can be named, for example, the potassium permonosulphate triple salt, $K_2SO_4.KHSO_4.2KHSO_5$, which is commercially available from E. I. DuPont de Nemours and Company under the trade-name "Oxone".

All these peracid compounds are usable in the bleach and/or detergent compositions of the invention and may be present in an amount of from 0.5 to about 65% by weight of the total composition, preferably from 1–50%, particularly preferably from 1–25% by weight.

At these levels, the peracid bleach will be effective to give in the following test an increase in stain removal from tea-stained cotton of at least two reflectance units more than a similar product in which the peracid is replaced by sodium sulphate.

The tea-stained cotton is prepared as follows. A length of cotton sheeting is boiled for 1 hour in a concentrated infusion of tea. The cloth is removed, rinsed thoroughly, and dried at room temperature. The peracid is tested in the following product:

| Component (on anhydrous basis) | Parts by Weight |
|---|---|
| Linear alkyl (C12 to C18) benzene sulphonate | 9 |
| Nonionic 7EO | 4 |
| Sodium tripolyphosphate | 33 |
| Sodium alkaline silicate | 6 |
| Sodium carboxymethylcellulose | 1 |
| Magnesium silicate | 1 |
| Ethylene diaminetetraacetic acid | 0.2 |

-continued

| Component (on anhydrous basis) | Parts by Weight |
|---|---|
| Water | 10.8 |
| Sodium sulphate | see below |

The level of sodium sulphate is adjusted so that, after addition of the bleach, the parts of weight of the total formulation add up to 100.

4 gms of product is dissolved in 1 litre of 0° H water, and the pH of the solution is adjusted to equal the pKa of the peracid under test, using small quantities of sulphuric acid or sodium hydroxide solution. The test cloths are washed at 40° C. for 30 mins in a Tergotometer operating at 75 r.p.m. After the wash the test cloths are rinsed and dried. The reflectances of the cloths at 460 nm are read before and after washing, using an Elrepho reflectometer fitted with an external filter to cut out incident radiation of less than about 400 nm. (Elrepho is a Trade Mark).

It is to be noted this test method defines the peracid environment in which the perfume compositions of the invention are usable. The increase of at least two reflectance units in the bleach activity will be dependent on the type of peracid used and its level in the formulation.

The peracid stability values, abbreviated herein to PSV, of perfume components were established by storage in a laundry powder base containing a peracid component.

A laundry powder base with the formulation quoted was prepared.

| Component | Parts by wt |
|---|---|
| Linear alkyl (C12–C18) benzene sulphonate | 9.0 |
| Nonionic surfactant (Synperonic A7) | 4.0 |
| Sodium tripolyphosphate | 33.0 |
| Alkaline sodium silicate | 6.0 |
| Sodium carboxymethylcellulose | 1.0 |
| Magnesium silicate | 1.0 |
| EDTA | 0.2 |
| Sodium sulphate | 15.0 |
| Water | 10.8 |
| Peracid granules | 20.0 |
| | 100.0 |

The peracid granules were obtained from Degussa GmbH of West Germany and had the composition:

| Component | % wt |
|---|---|
| Alpha, omega-Diperoxydodecanedioic acid (DPDDA) | 12.0 |
| Magnesium sulphate | 4.0 |
| Sodium sulphate | 83.0 |
| Binder | 1.0 |
| | 100.0 |

Laundry powder base (500 g) was dosed with perfume material (1.5 g) and then passed through a 20 mesh sieve. The remainder of the base powder (300 g) was added to the sieved base, placed in a Y-cone blender and blended for 10 minutes. After 10 minutes, DPDDA granules (200 g, 12% DPDDA content) were added and the whole was blended for a further 20 minutes.

Samples were taken from each port of the Y-cone blender and combined (10 g total) for initial analysis. The remainder was sampled into two sealed glass jars. The jar samples were stored at 0° C. (control sample) and 37° C. for 4 weeks. After storage, the perfume was extracted from the samples (solvent extraction with a suitable solvent) and analysed by gas-chromatography (gc), to determine the percentage of each perfume ingredient remaining relative to the control.

The analytical procedure was repeated ten times for a range of five perfume materials. Statistical analysis of the gc data gave an average percentage coefficient of variance of 1.25.

RESULTS

The test method described was applied to a number of perfume components and the peracid stability values (PSV) quoted as a percentage in Table I.

TABLE I

| | PSV (%) |
|---|---|
| (i) Saturated alcohols: | |
| Tetrahydrogeraniol | 81 |
| Decanol | 100 |
| Phenylethyl alcohol | 92 |
| Phenylpropyl alcohol | 100 |
| o-tert-Butylcyclohexanol | 100 |
| Dihydroterpineol | 90 |
| di-Isobutylcarbinol | 100 |
| 2,6-Dimethyl-2-heptanol | 89 |
| Tetrahydrolinalol | 88 |
| (ii) Saturated esters: | |
| Tetrahydrolinalyl acetate | 86 |
| Menthyl acetate | 88 |
| ortho-tert-Butylcyclohexyl acetate | 100 |
| Dimethyl benzyl carbinyl acetate | 99 |
| (iii) Saturated aromatic ketones: | |
| Tonalid (6-acetyl-1,1,3,4,4,6-hexamethyltetrahydronaphthalene obtainable from PFW of Amersfoort, Netherlands) | 74 |
| Benzophenone | 98 |
| Methyl naphthyl ketone | 76 |
| Traseolide (6-acetyl-1-isopropyl-2,3,3,5-tetramethylindane from Quest International of the Netherlands) | 58 |
| (iv) Saturated lactones: | |
| Hexadecanolide | 92 |
| Sclareolide | 73 |
| Lactoscatone (gamma-lactone of 1-hydroxy-3,10,10-trimethyl-bicyclo [4,4,10] decane-3-carboxylic acid and isomers from Dragoco of Holzminden, Germany) | 82 |
| (v) Saturated nitriles: | |
| Frutonile (2-methyldecanonitrile from Quest International of Ashford, England) | 98 |
| Dodecyl nitrile | 100 |
| Frescile (3-methyldodecanonitrile from Quest International) | 100 |
| (vi) Saturated ethers: | |
| Celestolide (4-acetal-6-tertbutyl-1, 1-dimethyl indane from IFF of Union Beach, NJ, USA) | 83 |
| Cedramber (cedryl methyl ether from IFF) | 81 |
| Anther (Iso-amyl phenylethyl ether from Quest International) | 100 |
| Phenylethyl methyl ether | 93 |
| (vii) Saturated acetals: | |
| Herboxane (2-butyl-4,4,6-trimethyl dioxan from Quest International) | 69 |
| Indolal (indano [1,2-d]1,3-dioxane from Dragoco) | 100 |
| (viii) Saturated phenols: | |
| Carvacrol | 84 |
| (ix) Saturated hydrocarbons: | |
| Diphenyl methane | 99 |
| para-Cymene | 99 |
| (x) Aromatic nitromusks: | |
| Moskene (Musk cymene from Givaudan of Geneva, Switzerland) | 96 |

TABLE I-continued

| | PSV (%) |
|---|---|
| (xi) Saturated salicylates: | |
| Hexyl salicylate | 51 |
| Amyl salicylate | 34 |
| Isoamyl salicylate | 10 |
| Benzyl salicylate | 0 |
| (xii) Saturated aldehydes: | |
| Dodecanal | 0 |
| Lilial 3-(para-tert.butylphenyl)-2-methylpropanal from Givaudan) | 0 |
| (xiii) Saturated formates: | |
| Phenylethyl formate | 0 |
| CP formate (cyclohexane-1-methanol-alpha-3,3-trimethyl formate from IFF) | 0 |
| (xiv) Saturated aliphatic ketones: | |
| Fleuramone (2n-heptylcyclopentanone from IFF) | 0 |
| Orivone (4-(1,1-dimethylpropyl)-cyclohexanone from IFF) | 0 |
| (xv) Unsaturated alcohols: | |
| Primary | |
| 9-Decenol-1 | 6 |
| Cinnamic alcohol | 0 |
| Geraniol | 0 |
| Citronellol | 0 |
| Secondary | |
| Amylvinyl carbinol | 0 |
| Tertiary | |
| alpha-Terpineol | 0 |
| Linalol | 0 |
| (xvi) Unsaturated esters: | |
| Florocyclene (hexahydro-4, 7-methanoinden-5-yl propionate from Quest International) | 0 |
| Linalyl acetate | 0 |
| Terpinyl acetate | |
| Jasmacyclene (hexahydro-4, 7-methanoinden-5-yl acetate from Quest International) | 4 |
| (xvii) Unsaturated ketones: | |
| alpha-iso-Methylionone | 0 |
| Lixetone (acetylated cedarwood from Quest International) | 0 |
| alpha-Ionone | 0 |
| (xviii) Unsaturated nitriles: | |
| Geranyl nitrile | 0 |
| Palmanitrile (isomeric mixture of bicyclic nitriles from Dragoco) | 1 |
| (xix) Unsaturated esters: | |
| Pelargene (from Quest International) | 0 |
| (xx) Unsaturated phenols: | |
| Eugenol | 12 |
| (xxi) Unsaturated aldehydes: | |
| Hexylcinnamic aldehyde | 5 |
| Amylcinnamic aldehyde | 0 |
| Triplal (mixture of 3,5-dimethyl-3-cyclohexene-1-carboxaldehyde and 2,4-dimethyl-3-cyclohexene-1-carbox-aldehyde from IFF) | 0 |
| (xxii) Unsaturated epoxides: | |
| Myroxide (cis/trans isomers of ocimene epoxide from Firmenich of Geneva, Switzerland) | 0 |

Examples of perfume compositions satisfying the requirements of the present invention are given below.

| Component | Class | Parts per thousand |
|---|---|---|
| Composition A | | |
| decanol | (i) | 50 |
| phenylpropyl alcohol | (i) | 60 |
| diphenylmethane | (ix) | 50 |

-continued

| Component | Class | Parts per thousand |
|---|---|---|
| Herboxane | (vii) | 100 |
| dimethylbenzylcarbinyl acetate | (ii) | 150 |
| p-tertbutylcyclohexyl acetate | (ii) | 175 |
| dihydroterpineol | (i) | 30 |
| tetrahydrolinalol | (i) | 150 |
| Cedramber | (vi) | 40 |
| hexadecanolide | (iv) | 50 |
| Anther | (vi) | 35 |
| phenylethyl alcohol | (i) | 60 |
| Traseolide | (iii) | 50 |
| | | 1,000 |
| Composition B | | |
| dodecyl nitrile | (v) | 5 |
| diphenylmethane | (ix) | 10 |
| carvacrol | (viii) | 5 |
| Herboxane | (vii) | 75 |
| phenylethyl alcohol | (i) | 350 |
| dimethylbenzylcarbinyl acetate | (ii) | 80 |
| phenylpropyl alcohol | (i) | 50 |
| Celestolide | (vi) | 20 |
| Traseolide | (iii) | 175 |
| Moskene | (x) | 30 |
| decanol | (i) | 40 |
| Anther | (vi) | 60 |
| tetrahydrolinalyl acetate | (ii) | 50 |
| p-tertbutylcyclohexyl acetate | (ii) | 50 |
| | | 1,000 |
| Composition C | | |
| phenylethyl alcohol | (i) | 300 |
| decanol | (i) | 10 |
| tetrahydrolinalol | (i) | 50 |
| tetrahydrogeraniol | (i) | 3 |
| p-tertbutylcyclohexyl acetate | (ii) | 150 |
| Traseolide | (iii) | 200 |
| hexadecanolide | (iv) | 10 |
| Cedramber | (vi) | 10 |
| Moskene | (x) | 30 |
| Herboxane | (vii) | 62 |
| Frescile | (v) | 5 |
| dihydroterpineol | (i) | 20 |
| phenylpropyl alcohol | (i) | 150 |
| | | 1,000 |
| Composition D | | |
| phenylethyl alcohol | (i) | 250 |
| phenylpropyl alcohol | (i) | 100 |
| o-tert.butylcyclohexyl acetate | (ii) | 30 |
| dimethylbenzylcarbinyl acetate | (ii) | 180 |
| benzophenone | (iii) | 10 |
| Tonalid | (iii) | 60 |
| Galaxolide | (vi) | 160 |
| Celestolide | (vi) | 10 |
| Anther | (vi) | 50 |
| Frutonile | (v) | 5 |
| methyl naphthyl ketone | (iii) | 20 |
| phenylethyl methyl ether | (vi) | 35 |
| tetrahydrolinalol | (i) | 90 |
| | | 1,000 |

BLEACH AND DETERGENT COMPOSITIONS

Detergent compositions containing peracids would be applied mainly to the cleaning of fabrics but are also usable to clean other substrates, e.g. hard surfaces.

Builder and detergent active components are well characterised in the field of detergent technology. Examples of these components are listed hereafter and full descriptions of these and other examples of these components will be found in "Surface Active Agents" by Schwartz and Perry published by Interscience (1949) and Volume II by Schwartz, Perry and Berch published by Interscience (1958). Examples of detergent actives usable at a level of from 5–50% by weight in the compositions, which may be built or unbuilt, of the invention are present in the general classes of anionic, nonionic amphoteric, betaine and cationic actives. Specific classes usable singly or in admixture are:

(a) alkylaryl sulphonates having an alkyl chain from C10 to C15.

(b) alkyl (C12 to C18) sulphonates, wherein the alkyl group is branched or linear;

(c) alkali metal salts of alkane sulphonates having an alkyl chain length of from C11 to C14, these actives can be prepared by the reaction of a bisulphite ion species with an olefin;

(d) alkene sulphonates having a chain length from C14 to C24;

(e) sulphates of alcohols having chain lengths from 12 to 15, including branched chain alcohols obtainable under the Trade Mark "Dobanol";

(f) alkali metal salts of C8 to C22 long chain fatty acids; and (g) dialkali metal salts of sulphonated saturated fatty acids having a chain length from C12 to C20;

(h) fatty acid ester sulphonates having from about 8 to about 20 carbon atoms in the fatty acid chain;

(i) nonionic detergent actives, for example polyoxyalkylene derivatives of alcohols, alkylamides and alkanolamides, polyoxyalkylene esters of acids, alkylene oxide block polymers (e.g. PLURONIC), polyol esters, acyl alkanolamides and ethoxylated alcohols (C8 to C20) having a degree of ethoxylation between 2 and 20. PLURONIC is a trade-mark.

The builder may consist of sequestrant, precipitant or ion-exchange materials, or their mixtures. Specific examples are sodium tripolyphosphate or pyrophosphate, sodium nitrilotriacetate, sodium oxydiacetate, sodium citrate, sodium tartrate and sodium carboxymethyloxy succinate, polymeric carboxylic acid salts derived from one or more of acrylic acid, methacrylic acid, maleic anhydride, and glyoxylic acid, e.g. Builder U of Monsanto, sodium carbonate with or without an insoluble seed material such as calcium carbonate, e.g. calcite, sodium orthophosphate, sodium C16–22 alkyl or alkenyl succinates, sodium C14 to C22 soaps, sodium alpha-sulpho fatty acid salts, soluble silicates and partially soluble layered silicates, amorphous or crystalline alumino-silicates, e.g. zeolites X, Y and A, and mixtures of any of the above. These materials are normally present in an amount of about 5 to 80%, preferably from 10 to 60% by weight.

For many applications, a foam controller is desirably present. Non-limiting examples of these are C20 to C24 fatty acids or their salts, alkylphosphates, ethylene distearamide, and hydrophobed mineral particles such as silanised silica, all optionally mixed with hydrocarbon oils, waxes or polydimethylsiloxanes. These may be incorporated in any suitable amount and manner known to the art, e.g. sprayed on to a finished powder either directly or as a dispersion in a liquid carrier, e.g. an ethoxylated alcohol, or sprayed on to a solid porous substrate to form an adjunct which is then added to the formulation.

Stabilising agents for the peracid may also be present. The amounts of such agents, when present, is normally small, e.g. from 0.05–10% by weight, preferably from 0.1–5% by weight. Non-limiting examples of these are ethylene diamine tetra-acetic acid, diethylene triamine penta-acetic acid, ethylene diamine tetra-(methylene phosphonic acid), diethylene triamine penta-(methylene phosphonic acid) and their alkali(ne earth) metal salts, dipicolinic acid or its salts, and magnesium silicate.

Other bleaches may be present in addition to the peracid bleach, such as hydrogen peroxide sources e.g. sodium perborate monohydrate and tetrahydrate, optionally with a precursor such as TAED. A list of possible precursors is given in EP 0070079 (Unilever).

The composition may include one or more optical brightening agents, such as the diaminostilbene/cyanuric chloride types, e.g. Blankophor MBBH, distyrylbenzene types, e.g. Tinopal CBS and Tinopal BLS, or triazole types, e.g. Blankophor BHC and Tinopal RBS. A combination of Blankophor BHC and Tinopal BLS is preferred for cotton fabrics and Tinopal RBS is preferred for nylon. Blankophor (ex Bayer) and Tinopal (ex Ciba-Geigy) are trade-marks.

Various polymeric materials are of value as powder structurants, antiredeposition and anti-soiling agents, and for fabric care. Examples of these are the polymers and copolymers of monomers such as acrylic acid, methacrylic acid, and maleic anhydride, polymers and copolymers of ethylene oxide and/or propylene oxide, cellulose ethers, sodium carboxymethylcellulose, and polyvinylpyrrolidone.

Buffering or pH adjusting agents may also be present to achieve a desired acidity or alkalinity. These are normally inorganic salts and examples are sodium metaborate, borax, sodium carbonate or bicarbonate, trisodium orthophosphate, disodium hydrogen phosphate, monosodium dihydrogen phosphate, tetrasodium pyrophosphate, trisodium hydrogen pyrophosphate, disodium dihydrogen pyrophosphate, sodium bisulphate, alkaline sodium silicate and neutral sodium silicate. Suitable organic salts and acids may also be used, in addition to or alternative to the inorganic salts. It is desirable that solid buffering agents be used in solid formulations, e.g. powders, but liquid pH adjusting agents, e.g. sulphuric acid, are used in liquid, gel or semi-solid formulations.

A preferred optional ingredient is an enzyme or a mixture of enzymes, which may be proteases and/or lipases. Specific examples of proteases are Alcalase®, Savinase® and Esperase® (obtainable from Novo of Denmark), Maxatase® and Maxacal® (obtainable from Gist-Brocades of Netherlands), Kazusase® (obtainable from Showa-Denko of Japan), Optimase® (obtainable from Miles Kali-Chemie of Hanover, West Germany), and Superase® (obtainable from Pfizer of USA). Specific examples of lipases are fungal lipases obtained from Humicola Lanuginosa or Thermomyces Lanuginosa, and bacterial lipases which react positively with the antibody of the lipase from Chromobacter Viscosum.

The composition may also include materials which confer a soft feel to washed fabrics. These may be one or more of hereinafter described clays at formulation levels of 2–15%, organo-clays at levels of 1–10%, amines and/or cationics at levels of 1.5–10%, silicones at levels of 0.5–5% and cellulase at levels of 0.1–10%.

Suitable clays are phyllosilicate clays with a 2:1 layer structure, the silicate layer being either dioctahedrally or trioctahedrally co-ordinated, and include the species saponite, hectorite, beidellite, or montmorillonite. Such materials are classed as smectite minerals, the most commonly distributed form being the bentonite earths, the major component of which is montmorillonite.

Suitable organo-clays are as described above, with the proviso that the alkali(ne earth) metals or proton exchangeable cations are partially or totally replaced with organic cationic materials.

Suitable amines are primary, secondary, or tertiary mono- or di- C10–C26 alk(en)yl amines; the tertiary dialkylamines in which the third alkyl chain is a C1–C4 alkyl are preferred. Other suitable amines are described in EP 0023367 (Procter & Gamble) and are tertiary amines with two C10–C26 alk(en)yl chains with the third group a moiety of several possible structures.

Suitable cationics are water-soluble or insoluble quaternary ammonium compounds of general formula (R1R2 R3R4N)+Y− wherein at least one but not more than two of R1 and R4 is an organic radical containing a group selected from C16–C22 alkyl, or alkylphenyl or alkybenzyl having to 16 carbon atoms in the alkyl chain, the remaining R groups being selected from hydrocarbyl groups having 1 to 4 carbon atoms, C2–C4 hydroxyalkyl groups, cyclic structures in which the nitrogen forms part of the ring, e.g. imidazolinium compounds, and wherein Y− is a compatible counterion giving electrical neutrality.

Suitable silicones are organofunctional polyalkyl siloxanes, e.g. as described in EP 0150867 (Procter & Gamble).

Suitable cellulases are bacterial or fungal cellulases having a pH optimum between 5 and 11.5, e.g. as described in GB 2075028 (Novo), GB 2095275 (Kao Soap), or GB 2094826 (Kao Soap).

Cellulose ethers at a formulation level of 0.05–5% may be used as a deposition aid with 2–40% of an organic hydrophobic softening material such as a calcium soaps, amines, cationics and mixtures of these. Suitable cellulose ethers are nonionic substituted cellulose ethers with an HLB between 3.1 and 3.8, gel points of less than 58° C. and contain substantially no hydroxyalkyl groups containing more than two carbon atoms.

Other ingredients, for example starch, colouring materials, corrosion inhibitors, opacifiers, germicides and fillers, e.g. sodium sulphate, talc, calcite are optionally present.

The detergent formulation may be granular, liquid, a solid bar, or a semi-solid, e.g. a gel or paste. It may be supplied in bulk, e.g. in a packet or bottle, or in unit dose form, e.g. sachets or tablets.

Gelled formulations containing the peracid as a solid suspension may require a thickening agent. Suitable thickening agents may be organic or inorganic, and examples are laponite or smectite clays, colloidal silicas, natural starches, gums and mucilages, e.g. corn, rice, and wheat starches, gum agar, gum arabic, and carrageenan, modified natural polymers, e.g. starch esters, carboxylmethyl cellulose, cellulose ethers, and hydrolysed proteins( and synthetic polymers, e.g. polyacrylamides, polymers and copolymers of acrylic acid, methacrylic acid and maleic anhydride monomers. The level of thickener used depends on the level and type of salts present in the formulation, but the gel will normally have a viscosity of 200–100,000 centipoise, preferably 200–20,000 centipoise.

EXAMPLES OF POWDER FORMULATIONS

| COMPONENT | % in formulation | | | | | | | | | |
|---|---|---|---|---|---|---|---|---|---|---|
| | I | II | III | IV | V | VI | VII | VIII | IX | X |
| Linear Alkylbenzene Sulphonate | 6 | 9 | 6 | 4 | 4 | 9 | 6 | 9 | 8 | — |
| Nonionic 7 EO | 7 | 4 | 7 | 9 | 9 | 4 | 7 | 4 | 3.5 | — |
| Soap (hardened tallow) | — | — | — | — | — | — | — | — | 3.5 | — |
| Soap (80/20 tallow/coconut) | — | — | — | — | — | — | — | — | — | 30 |
| STPP | 23 | 33 | 15 | — | 20 | — | 10 | — | — | 10 |
| Zeolite 4A | — | — | — | 25 | 15 | 20 | 20 | 40 | — | — |
| NTA | — | — | — | — | — | 5 | — | — | — | — |
| Sodium orthophosphate | — | — | 5 | — | — | — | — | — | — | — |
| Sodium carbonate | — | — | 7 | 5 | — | — | — | — | 30 | 15 |
| Calcite | — | — | — | — | — | — | — | — | 20 | — |
| Polyacrylic acid | 2 | — | — | — | — | 2 | — | 1.5 | — | — |
| Acrylate/maleate copolymer | — | — | 1 | 5 | — | — | — | — | — | — |
| Alkaline Silicate | 7 | 6 | 7 | — | 5 | — | 3 | — | 6 | — |
| Neutral Silicate | — | — | — | — | — | 4 | — | — | — | — |
| DPDDA granules (12% active content) | 20 | 20 | — | 20 | — | 20 | 20 | 20 | — | — |
| K-Monopersulphate triple salt | — | — | 16 | — | 18 | — | — | — | 16 | 20 |
| Sodium bicarbonate | 10 | 10 | — | 4 | — | — | 10 | — | — | — |
| Sodium sulphate | 12 | 4 | 23 | 14 | 15 | 21 | 10 | 11 | — | 11 |
| SCMC | 1 | 1 | 1 | 1 | 1 | 1 | 1 | 1 | 1 | 1 |
| EDTA | 0.2 | 0.2 | 0.2 | 0.2 | 0.2 | 0.2 | 0.2 | 0.2 | 0.2 | 0.2 |
| Perfume Composition A | — | — | 0.3 | 0.3 | — | — | — | — | 0.3 | 0.3 |
| Perfume Composition B | 0.3 | — | — | — | — | 0.3 | — | — | — | — |
| Perfume Composition C | — | 0.3 | — | — | — | — | — | 0.3 | — | — |
| Perfume Composition D | — | — | — | — | 0.3 | — | 0.3 | — | — | — |
| Water, Minors | up to 100 | | | | | | | | | |

The minor components include for example additional stabilisers, fluorescers, enzymes and foam control systems.

EXAMPLE OF LIQUID FORMULATION

| Component | % in formulation XI |
|---|---|
| Linear alkylbenzene sulphonate | 7 |
| Nonionic 7EO | 3 |
| Sodium sulphate | 7 |
| EDTA | 0.5 |
| DPDDA (100% active ingredient) | 10 |
| Perfume Composition A | 0.2 |
| Water, minors | to 100 |

One minor component is a pH adjusting agent to bring the jpH into the range 2.5 to 6.5, more preferably 3.5 to 4.5.

EXAMPLES OF GEL FORMULATIONS

| Component | % in formulation | | |
|---|---|---|---|
| | XII | XIII | XIV |
| DPDDA (100% active ingredient) | 15 | 10 | 15 |
| Laponite clay | — | — | 6 |
| Polyacrylic acid* | — | 1 | — |
| Corn starch | 13 | — | — |
| Perfume Composition B | 0.3 | — | — |
| Perfume Composition C | — | 0.25 | — |
| Perfume Composition D | — | — | 0.25 |
| Citric acid | 0.3 | — | 0.3 |
| KH2PO4 | — | 1 | — |
| EDTA | 0.2 | 0.2 | 0.5 |
| Water | to 100 | | |

*M.W. ca $4 \times 10^6$.

We claim:

1. A bleach composition comprising 0.5 to 65% by weight of a peracid bleach selected from the group consisting of monopersulphate salts and organic peroxyacids having the general formula $$HO-O-\overset{\overset{\displaystyle O}{\|}}{C}-(O)_n-R-Y$$

wherein R is a radical selected from the group consisting of an alkylene or substituted alkylene group containing 1 to 20 carbon atoms, and an arylene group containing from 6 to 8 carbon atoms, n is 0 to 1, and Y is selected from the group consisting of hydrogen, halogen, alkyl, aryl and any group which provides an anionic moiety in aqueous solution.

and from 0.01 to 2.5% by weight of at least five classes of perfume components which do not contain alkenyl or alkynyl groups and have a Peracid Stability Value of at least 65% selected from the following classes:

(i) saturated alcohols
(ii) saturated esters
(iii) saturated aromatic ketones
(iv) saturated lactones
(v) saturated nitriles
(vi) saturated ethers
(vii) saturated acetals
(viii) saturated phenols
(ix) saturated hydrocarbons, and
(x) aromatic nitromusks.

2. A bleach composition according to claim 1, wherein said perfume components have a Peracid Stability Value of at least 80%.

3. A bleach composition according to claim 1, further containing 5% to 50% by weight of a detergent active material.

4. A bleach composition according to claim 1, wherein the peracid bleach is 1,12-diperoxydodecane dioic acid.

5. A bleach composition according to claim 1, wherein the peracid bleach is the monopersulphate triple salt K2SO4.KHSO4.2KHSO5.

6. A bleach composition according to claim 1, wherein Y is a radical selected from the group consisting of:
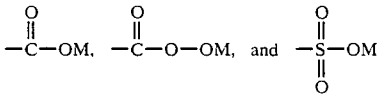
wherein M is hydrogen or a water-soluble, salt-forming cation.
* * * * *